US005294005A

United States Patent [19]

Hedges

[11] Patent Number: 5,294,005

[45] Date of Patent: Mar. 15, 1994

[54] PORTABLE MODULAR SPORTS EQUIPMENT RACK ESPECIALLY SUITED FOR USE AT GAMES

[76] Inventor: Robert S. Hedges, 7310 E. 201st Ter., Belton, Mo. 64012

[21] Appl. No.: 999,140

[22] Filed: Dec. 31, 1992

[51] Int. Cl.[5] ..... A47F 7/00

[52] U.S. Cl. ..... 211/13; 211/60.1; 211/87

[58] Field of Search ..... 211/13, 14, 87, 60.1, 211/123, 124; D6/552

[56] References Cited

U.S. PATENT DOCUMENTS

| | | | |
|---|---|---|---|
| 1,077,513 | 11/1913 | Eagleson | 211/124 |
| 1,299,556 | 4/1919 | Crecelius | 211/105.3 |
| 2,546,720 | 3/1951 | Brothers | 211/123 X |
| 2,577,860 | 12/1951 | Schoor | 211/123 X |
| 2,618,419 | 11/1952 | Vanish | 224/5 |
| 2,643,775 | 6/1953 | Franklin | 211/123 X |
| 3,411,633 | 11/1968 | Magnuson | 211/13 |
| 3,424,314 | 1/1969 | Cornelsen | 211/105.3 |
| 4,193,495 | 3/1980 | Keeley . | |
| 4,415,093 | 11/1983 | Livingston | 211/113 |
| 4,629,065 | 12/1986 | Braaten | 206/315.1 |
| 4,784,276 | 11/1988 | Gochanour | 211/89 |
| 4,819,812 | 4/1989 | Demarest, Jr. | 211/1.3 |
| 4,854,456 | 8/1989 | Lee | 211/14 |
| 4,869,378 | 9/1989 | Miller | 211/94 |
| 699,9071 | 5/1902 | Poschmann | 211/124 |

*Primary Examiner*—Alvin C. Chin-Shue
*Assistant Examiner*—Sarah A. Lechok
*Attorney, Agent, or Firm*—Kenneth W. Iles

[57] ABSTRACT

A portable modular sports equipment rack includes elongated telescoping tubular mounting members for accommodating a number of different types of hooks specifically adapted to receive different types of softball or baseball equipment, including at least fielding gloves, batting helmets and bats. Tubular spacer elements maintain a desired space between different pieces of equipment. A plurality of aligned apertures in a line along the tubular mounting members allow the length of the rack to be adjusted easily and is locked into the desired length by a snap button fastener engaged in two aligned apertures in the telescoping members. Aligned apertures through both side walls of the tubular members along a diameter of a cross section of the tubes adjacent to their ends allow the rack to be conveniently suspended from a chain link fence by a clevis pin through the apertures. The rack allows equipment to be stored at games, during travel to and from games, and at a remote storage cite, such as a locker room, if desired.

8 Claims, 4 Drawing Sheets

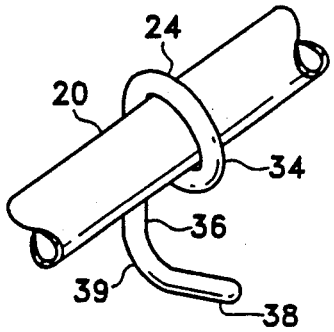
Fig. 2A
Fig. 2B
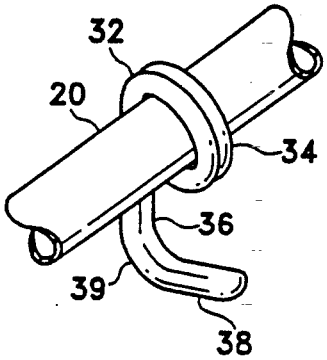
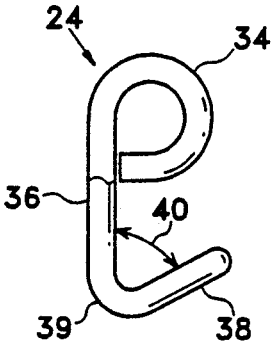
Fig. 2C
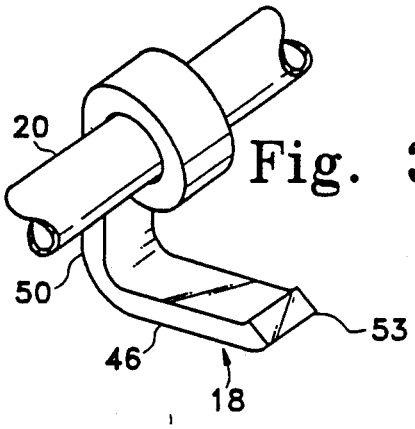
Fig. 3A
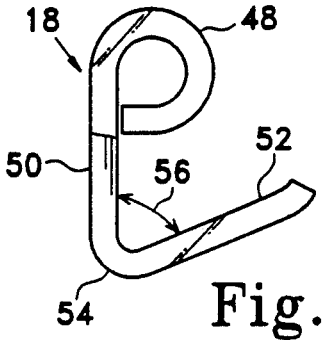
Fig. 3B
Fig. 4A
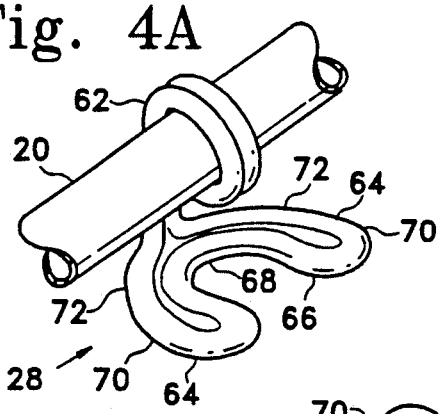
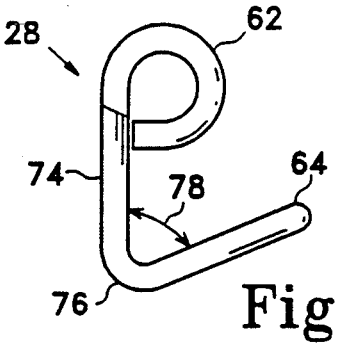
Fig. 4B
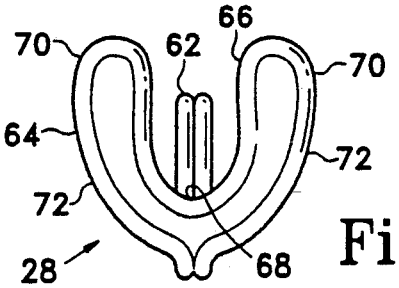
Fig. 4C

PORTABLE MODULAR SPORTS EQUIPMENT RACK ESPECIALLY SUITED FOR USE AT GAMES

BACKGROUND OF THE INVENTION

1. Field of the Invention

The present invention is related to an apparatus for storing sports equipment. More particularly, the present invention is directed to a sports equipment rack that is portable, easily assembled and disassembled and is especially well suited for transporting large amounts of softball or baseball equipment to a ball park and conveniently storing and displaying the equipment at the ball park to make it easily and readily available to the players.

2. Description of Related Art Including Information Disclosed Under 37 C.F.R. Sections 1.97–1.99

When a softball or baseball team assembles to play a game, a lot of equipment is required, including at least one fielding glove for each player, a number of batting helmets of difference sizes, a large number of bats of various sizes and a number of balls. Most amateur ball parks do not have adequate facilities for temporary and convenient storage of such equipment during games. Further, it is essential that such storage facility be capable of keeping the equipment in an organized and orderly fashion so that the players can quickly find the required piece of equipment. It is also very important that any such storage system can be readily assembled and disassembled or taken down because another team is usually ready to take the field for another game as soon as one game has concluded, and the teams that have just finished a game must leave the field and dugout area as quickly as possible.

Naturally, many different systems of shelves, racks and the like have been developed in the past, including some directed to this or a similar problem. Some of the patents issued in this art are discussed below.

U.S. Pat. No. 4,869,378, issued to Miller on Sep. 26, 1989, discloses a "Mounting Rail for Hospital Appliances and Bracket" comprising a rail for mounting horizontally on a wall. The rail has a longitudinal channel that can be used for retaining mating hooks and a longitudinal groove along the top of the rail, which can be used to retain specially shaped hooks. Heavier items can be held by a mating block having a locking thumb screw that clamps the hook onto the rail. The rail holds a plurality of differently shaped specialty hooks that can be slid along the rail for any desired horizontal spacing.

U.S. Pat. No. 4,854,456, issued to Lee on Aug. 8, 1989, discloses a "Rack Structure for Balls and Related Equipment" comprising a frame for mounting on a solid, flat wall, a plurality of spaced parallel rods, each of which defines a space between an individual rod and the wall upon which the rack is mounted. Balls are stored between one of the rods and the wall. The rack further includes end plates having a plurality of notches for holding baseball bats in a vertical position by retaining the knob at the end of the bats. A plurality of fixed and moveable hooks depend from one or more of the rods. The illustrated hooks are modified S-hooks.

U.S. Pat. No. 4,819,812, issued to Demarest, Jr. on Apr. 11, 1989, discloses a "Self-Contained Portable Hanging Clothes Dryer" comprising a telescoping rod in the form of a shower curtain rod from which a plurality of folding clothes hangers is suspended.

U.S. Pat. No. 4,784,276, issued to Gochanour on Nov. 15, 1988, discloses a "Hanger" for hanging garments such as pants and skirts. Of greatest interest is the shape of the spacer elements, which maintain a space between adjacent garments and have a curved paddle-like shape.

U.S. Pat. No. 4,629,065, issued to Braaten on Dec. 16, 1986, discloses a "Baseball Equipment Holder" comprising an elongated large diameter tubular housing having a diameter sufficient to accommodate baseballs, which are inserted through large cut out portions in the side wall of the tube. Hangers extend downwardly from the housing for holding baseball equipment, such as gloves. Notches in the tubular members are adapted to hold bats vertically by the knobs on the ends of the bat handles. A plurality of hooks may be used to attach the equipment holder to a fence.

U.S. Pat. No. 4,415,093, issued to Livingston on Nov. 15, 1983, discloses a "Garment Hanger Spacing Apparatus" comprising a plurality of circularly shaped spaced collars having hanger receiving elements comprising an aperture in the bottom of the hanger receiving element or portion of the collars. The collars can slide along the rod or bar they are mounted on.

U.S. Pat. No. 4,193,495, issued to Keeley on Mar. 18, 1980, discloses a "Portable Sports Equipment Organizer" comprising a rigid board having a plurality of specialized shaped hangers for storing bats, balls, and helmets. The board can be designed to be folded in two for transport and may be used to carry equipment to the ball park, as well as to store it while at the ball park. The board can be attached to a chain-link fence or backstop by hooks that are mounted on the board. A plurality of U-shaped clamps hold the bats and a plurality of L-shaped clamps hold the helmets. This device is heavy, awkward and unwieldy.

U.S. Pat. No. 3,411,633, issued to Magnuson on Nov. 19, 1968, discloses a "Checking Apparatus for Garment Racks and the Like" comprising a plurality of spaced apart hook elements, each hook comprising a bar or sheet metal element having a straight portion that is fastened to a vertical mounting surface and a curved bent portion designed to receive a garment, hat, or the like. The hooks are relatively wide and thick.

U.S. Pat. No. 2,618,419, issued to Vanish on Nov. 18, 1952, discloses a "Hammer Holster" comprising a flexible circular loop of coiled wire attached to a vertical leg portion of a clip that fastens the Hammer Holster to the user's belt.

U.S. Pat. No. 1,077,513, issued to Eagleson on Nov. 4, 1913, discloses a "Tobacco Supporting Lath" comprising a rod having a plurality of sharp hooks suspended from it. The hooks comprise members that depend vertically from the rod and include a sharp barb aligned horizontally.

U.S. Pat. No. 699,971, issued to Poschmann on May 13, 1920, discloses a "Curtain Pole" comprising an elongated rod having ornamental balls on each end and a slot along the length of the pole for receiving a plurality or specially adapted hooks that slide along the slot. The hooks are secured inside the pole by a small ball that is too large to slip through the slot, except at the key way at one end of the slot.

The use of a rod, pole or the like to suspend a variety of hooks has naturally been used before, as disclosed in the references (Miller '378; Demarest, Jr. '812; Gochanour '276; Braaten '065; Livingston '093; Eagleson '513; and Poschmann '971) and specialized hooks of one sort or another have been developed for many purposes, as illustrated many of the references discussed above.

Not shown in the references discussed herein, however, is a portable modular sports equipment rack specially adapted for easy set up and break down into a convenient package if desired, and for securely storing and transporting softball or baseball equipment to, from, and at a ball park. Therefore, a need exists for a portable modular sports equipment rack that is easy to assemble and disassemble, that can readily accommodate a large number of pieces of equipment (for example, enough equipment for an entire team), that facilitates storage of equipment at a ball park and while traveling to and from the ball park if desired, and at remote permanent storage sites, if desired, and that is so convenient to use during a game that it advances the game and the task of leaving the field after a game.

SUMMARY OF THE INVENTION

Accordingly, it is a primary object of the present invention to provide a portable modular sports equipment rack that facilitates storage of softball or baseball equipment at a ball park and while traveling to and from the ball park.

It is another object of the present invention to provide a portable modular sports equipment rack that can readily accommodate a large number of pieces of equipment.

It is another object of the present invention to provide a portable modular sports equipment rack that can be readily assembled and disassembled.

It is another object of the present invention to provide a portable modular sports equipment rack that can be stored or shipped in a small volume when broken down into its separate parts.

It is another object of the present invention to provide a portable modular sports equipment rack that easily accommodates different types of softball or baseball equipment and that can be designed to accommodate other types of sports equipment or tools.

It is another object of the present invention to provide a portable modular sports equipment rack that holds softball or baseball equipment securely but that allows a player to remove any particular piece of equipment easily and conveniently and to easily replace any particular piece of equipment on the rack when it is no longer needed.

It is another object of the present invention to provide a portable modular sports equipment rack that is convenient to use.

It is another object of the present invention to provide a portable modular sports equipment rack that is relatively inexpensive to manufacture and that can be made from a variety of materials.

A portable modular sports equipment rack according to the present invention provides a convenient apparatus for hanging softball (or baseball) equipment such as bats, gloves, helmets, and the like on a chain-link fence during the ball games or practices and for transporting such equipment to and from games. Further, if desired the same rack may be conveniently used for storing the equipment in an equipment room, manager's garage, or the like by hanging the rack or racks from a wall.

At amateur softball and baseball parks, chain-link fences are typically used to protect players not in the field and spectators from the action on the field, especially around home plate, and so this type of fence is almost always available at amateur ball parks and playgrounds.

The portable modular sports equipment rack according to the present invention comprises a metal tube, which may also include at least one telescoping tube of smaller diameter inserted into a larger diameter tube. Adjacent to each end of each tube is an aperture through both side walls of a tube and perpendicular to the length of the tube, i.e., across a diameter of the circular cross section of the tube, which allows the tubes to be suspended at any convenient height on a chain-link fence or other appropriate structure by the use of clevis pins or other fasteners.

Different types of hangers are suspended along the tube, with a different type of hanger specially designed for each different item of equipment, such as gloves, bats, and helmets. The gripping end of all hooks is coated with tool dip plastic coating or the like to increase the friction between the hook and the hanging article and to reduce abrasion and marring. The tubes and hooks are made of aluminum, but any suitable material, including plastic, could be used. In each case, any desired number of the specialized hooks can be mounted on one tube and the different types of hooks can be mixed on a single tube.

The glove hanger or hook comprises a small-diameter rod having one end bent or otherwise formed into a circular shape that slips onto the primary or secondary rod and is able to slide along the rod easily. The other end of the glove hook is bent or otherwise formed into an angle of about 45–65 degrees, with a preferred angle of 55 degrees, providing a hook for hanging gloves.

The ball bat hanger comprises a circular shaped end for slidable mounting on the tubular members and which flows into a yoke for accommodating a bat handle and retaining it by the knob at the end of the bat. The back portion of the bat hook is tangent to the cross section of the tubular mounting member and the fence that the rack is suspended from, maintaining that depending straight portion of the bat hook in a substantially vertical position whether or not a bat is being held in a specific bat hook. An angle of 60–80 degrees, with 75 degrees being preferred, lies between the yoke and the straight depending portion of the bat hook. As a player lifts a bat from a bat hook, the bat hook tends to be lifted up, which makes removal of the bat easier.

The helmet hook comprises a bar bent or otherwise formed, e.g., molded, at one end to form a circular shape or portion having an open end that slides along the tubular member. The other end of the helmet hanger is bent in a substantially L-shape with the angle between these two portions of the helmet hook being about 65–85 degrees, with the preferred angle being 75 degrees, and with the horizontal base member of the "L" shape (in side elevation) being substantially longer than the vertical member. The helmet hook is preferably made from bar stock so that the helmet engaging portion of the helmet hook has some width.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

BRIEF DESCRIPTION OF THE DRAWING

FIG. 2 consists of FIGS. 2A, 2B, and 2C, which illustrate a glove hook according to the present invention, including:

FIG. 2A is a fragmentary perspective view of one embodiment of a glove hook shown on a tubular member;

FIG. 2B is a fragmentary perspective view of an alternative embodiment of a glove hook; and FIG. 2C is side elevation of the glove hook of FIG. 2A.

FIG. 3 consists FIGS. 3A and 3B, which show a helmet hook according to the present invention, including:

FIG. 3A shows a fragmentary perspective view of a helmet hook mounted on a tubular member; and FIG. 3B shows a side elevation of the helmet hook of FIG. 3A.

FIG. 4, consists of FIGS. 4A, 4B and 4C, which illustrate a bat hook according to the present invention, including;

FIG. 4A shows a fragmentary perspective view of a bat hook mounted on a tubular member according to the present invention;

FIG. 4B shows a side elevation of the bat hook of FIG. 4A; and

FIG. 4C shows a bottom plan view of the bat hook of FIG. 4A.

FIG. 6 is a side elevation of a clevis hook used for fastening a sports equipment rack according to the present invention on a chain-link fence or the like.

DETAILED DESCRIPTION OF THE PREFERRED EMBODIMENTS

As required by the Patent Statutes and the case law, the preferred embodiment of the present invention and the best mode currently known to the inventor for carrying out the invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus disclosed herein as embodied in any appropriately specific and detailed structure.

Figure 1:
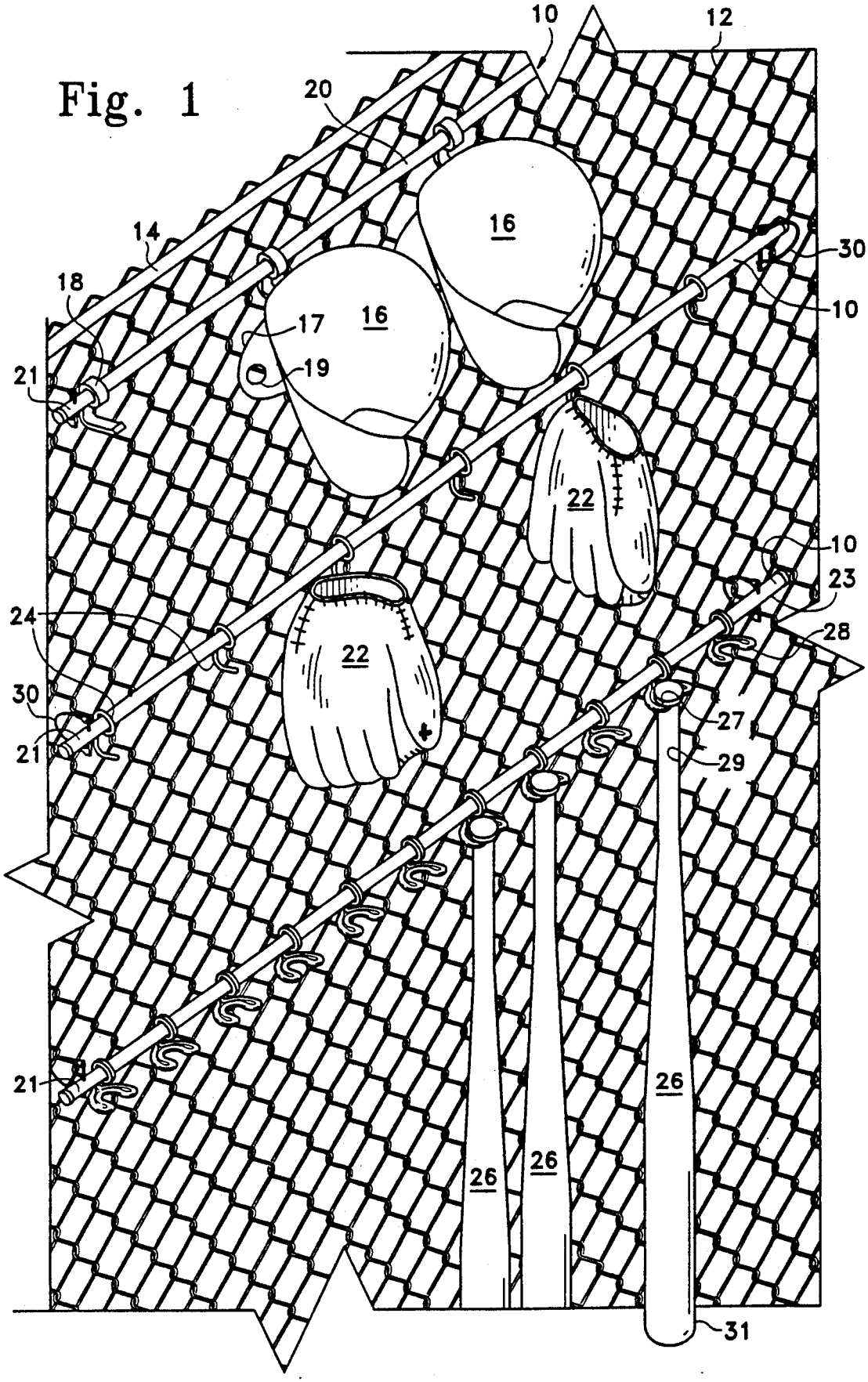
FIG. 1 is a perspective environmental view of a sports equipment rack according the present invention showing the rack in use on a chain-link fence, such as that typically found at amateur softball parks.

Referring now to FIG. 1, there is shown a perspective environmental view of a portable modular sports equipment rack 10 according to the present invention mounted on a chain-link fence 12 having framing rails or poles 14, such as that typically found in the backstop and foul line area of most amateur softball and baseball parks. In the preferred embodiment, the rack 10 includes at least two nesting telescoping tubular mounting members 20 that form a frame 21 for hanging hooks and equipment on, which are fastened to the chain link fence 12 by a clevis pin 30 at each end of the tubular members 20, as described in more detail below. This telescoping frame 21 is especially useful for storing gloves on the glove hooks 24 and batting helmets on the batting helmet hooks 18, but a single member frame 23 may be useful for these same purposes, if desired. Further, either a single member frame 23 or a telescoping frame 21 may also be used with the bat hooks 28 for storing a plurality of bats. Spaced along the tubular members 20 are a variety of specialized hooks, which include at least a plurality of helmet hooks 18 for suspending batting helmets 16, with one batting helmet 16 suspended by each helmet hook 18; a plurality of fielding glove hooks 24 for suspending a plurality of fielding gloves 22, with one glove typically suspended from each fielding glove hook 24; and a plurality of bat hooks 28, with one ball bat 26 suspended from each bat hook 28. Each batting helmet 16 further includes at least one ear flap 17 depending from main body of the helmet 16 and an ear hole 19 disposed within the ear flap 17 to allow more or less normal hearing to the user when wearing the helmet 16. Most helmets 16 designed for amateur play include an ear flap 17 on both sides of the helmet 16 so that it can be used by either left-handed or right-handed batters. Most professional helmets 16, however, have an ear flap 17 on only one side or the other. The bat hooks 28 may naturally be used for storing or suspending either baseball or softball bats 26 made from wood, aluminum or other materials. Each bat 26 is suspended by the knob 27 adjacent to the bat handle portion 29, which is above the barrel portion 31 of the bat 26, such as shown in FIG. 1. The knob 27 has a larger diameter than the handle portion 29, allowing the handle portion 29 of the bat 26 to be inserted in a yoke 64 (see FIG. 4) of the bat hook 28, which then retains the bat 26 by the knob 27 because the yoke 64 has an opening that is larger than a bat handle portion 29 but is smaller than the bat knob 27. The yoke 64 is sized to accommodate bats of any size that can be used by either children or adults in playing softball or baseball. The specific design of the various elements of the rack 10 are discussed in detail below.

Still referring to FIG. 1, in an alternative embodiment, a frame 21 consists of a single piece elongated member 23 which is suspended in the same manner as the telescoping frame 21, as discussed in detail below. The frame 21 is preferably a tubular member, but may be solid and may have any desirable cross section, such as octagonal, hexagonal, and the like. In these alterative shapes, it may be desired to form the frame 21 engaging portion of the equipment hooks to conform with the shape of the cross section of the frame.

Referring now to FIG. 2A there is shown one embodiment of a fielding glove hook, or a single weight glove hook 24, in place on a portion of a tubular member 20. The single weight fielding glove hook 24 has a curved upper portion 34 bent into a circular shape with an opening where the circle is not complete, having a diameter slightly larger than any tubular member 20 for allowing the glove hook 24 to be slidably mounted on the tubular members 20. The helmet hooks 18 (FIGS. 3A, 3B) and the bat hooks 28 (FIGS. 4A, 4B, and 4C) include similar curved hanger portions for suspending the hooks from the tubular members 20, as described below. In this configuration, none of the equipment hooks, that is, the glove hooks 24, batting helmet hooks 18 or the bat hooks 28 can be removed from, or accidentally become disengaged from, the tubular members 20 during the course of normal use, except by slipping off one end or the other of the tubular members 20.

Referring to FIG. 2C, a depending straight portion 36 of the glove hook 24 hangs down from the circular mounting hook portion 34 along a line that is essentially tangent to the circular pattern of the hook portion 34. A bend 39 is formed in the depending straight portion 36 to form a glove engaging portion 38 specially adapted for receiving the wrist strap of a conventional softball or baseball glove, although a glove may also be suspended from the glove hook 24 or 32 (FIGS. 2A, 2B and 2C) by a thong threaded through the fingers of the glove, or by the webbing between the thumb and index finger of the glove. The glove engaging portion 38 is bent at an angle 40 relative to the depending straight portion 36, which is 55 degrees in the preferred embodiment, but 16 which may range from about 45–65 degrees. This angle has been carefully engineered to provide a glove engaging portion 38 that is readily accessible and easy to use, but that will hold the glove securely, even when the rack 10 is shaken or otherwise moved. The three elements of the glove hook 24 lie in the same plane, that is, they are vertically aligned as viewed in the figures. The glove hook 24 is preferably formed by bending aluminum rod stock of suitable strength.

Referring now to FIG. 2B, there is shown an alternative embodiment of the glove hook, namely a double weight glove hook 32, which includes a circular mounting hook portion 34, a depending straight portion 36 and a glove engaging portion 38, and resembles the single weight glove hook 24 in every respect, save one, namely that the double weight glove hook 32 is formed from a single length of aluminum rod stock that is bent back along itself for the entire length of material required to form a glove hook. Thus, the shape of the single weight glove hook 24 is duplicated, but the double weight glove hook obviously has two separate, approximately parallel rod or wire members. This provides twice the strength of the single weight glove hook 24 and, more importantly, more than twice the surface area to contact the portion of the glove used for hanging it, thereby minimizing any stretching or bending of the glove that may result from its being suspended.

Referring now to FIGS. 3A, 3B, there is shown a helmet hook 18 for use with the portable modular sports equipment rack disclosed herein. The helmet hook is made from aluminum bar stock having a rectangular cross section 46, as seen in an end 53. Preferred dimensions for the end 53 are about $\frac{1}{4}\times\frac{3}{4}$ inches ($0.635\times1.9$ cm), which provides the width of contact with a helmet that is required to hold a helmet securely. The helmet hook 18 includes an upper portion comprising a circular curved mounting hook portion 48, which extends downwardly in a depending straight portion 50, which runs to a bend 54, which defines the end of the depending straight portion 50 and the beginning of a helmet engaging portion 52 lying at an angle 56 to the depending straight portion 52 of 75 degrees, with a range of 65–85 degrees being allowable. When a helmet is suspended from the helmet hook 18, the weight of the helmet tends to rotate the helmet hook 18 from its front, i.e., the leading edge of the helmet engaging portion 52, toward the fence or other supporting member that the rack 10 is suspended from, thereby pushing the helmet engaging portion 52 toward the horizontal. This requires that the angle 56 be less than 90 degrees in order to prevent a helmet from falling off the helmet hook 18. Thus the angle 56 has been arrived at from substantial experimentation and is not simply a matter of design choice. Further, the typical helmet includes a helmet liner that is circular about the lower inside circumference or perimeter of the helmet and this liner material is made of a low friction material that can become quite slippery when wet with, for example, perspiration. It has been found that, notwithstanding the careful design of the angle 56, helmets may slip off helmet hooks having a round cross section or a rectangular cross section less than that of the preferred size bar stock described herein.

Still referring to FIG. 3B, it is clear that the circular curved mounting hook portion 48, the depending straight portion 50 and the helmet engaging portion 52 are all integrally formed from a single piece of material and that these three elements lie in the same plane, that is, they are in vertical alignment.

Referring now to FIGS. 4A, 4B and 4C, there is shown the bat hook 28 designed for use in connection with the portable sports equipment rack 10, as disclosed herein. In the preferred embodiment, the bat hook 28 includes a circular or curved mounting hook portion 62 for retaining the bat hook 28 on a tubular member 20, which is accomplished by sliding the mounting hook portion 62 over the end of a tubular member 20 until it is in the desired location. This is the same manner that the helmet hook 18 and glove hooks 24, 32 are mounted on a tubular member 20. The bat hook 28 further includes a depending straight portion 74, roughly tangent to the curve of the mounting hook portion 62, which terminates at a bend 76 that leads to a central U-shaped channel portion 66, having a bottom, or maximum indentation point 68, and forming a bat knob engaging hook or yoke 64. The yoke 64 is sized to be large enough to accept the handle 29 (FIG. 1) of any bat and allow it to pass through the pair of opposed bat receiving arms 70 that form the yoke 64, but small enough that the knob 27 of the bat 26 will not pass through it. Thus, the bat 26 is suspended by its knob 27 in the yoke 64. The bat hook 28 is formed by forming a single length of wire members or aluminum rod stock 72 into the shape shown using a double-loop technique to form arms 70 having two roughly parallel runs. The arms 70 lie at an angle 78 to the straight depending portion 74 of 75 degrees but may lie in a range of about 60–80 degrees. This configuration holds a bat hook 28 in a substantially vertical position whether or not a bat is being held in the bat hook. When a player lifts a bat from a bat hook 28, frictional engagement of the bat 26 with the bat hook 28 lifts the yoke 64 by slightly rotating the entire bat hook 28 counterclockwise as viewed from the left-hand end of FIG. 4A. This movement make it easier to remove the bat.

Each of the three specialized equipment hooks, that is, the fielding glove hooks 24, 32, bat hooks 28 and helmet hooks 18, has an equipment engaging portion, as discussed above, and each such portion projects outwardly from the vertical mounting surface, such as the fence 12 shown in FIG. 1. Further, in the preferred embodiment of the rack 10, each of the equipment engaging portions of the hooks 18, 24, 28, 32 includes a coating of tool dip or other type of protective coating designed to prevent the hooks from marring the equipment.

Figure 8:
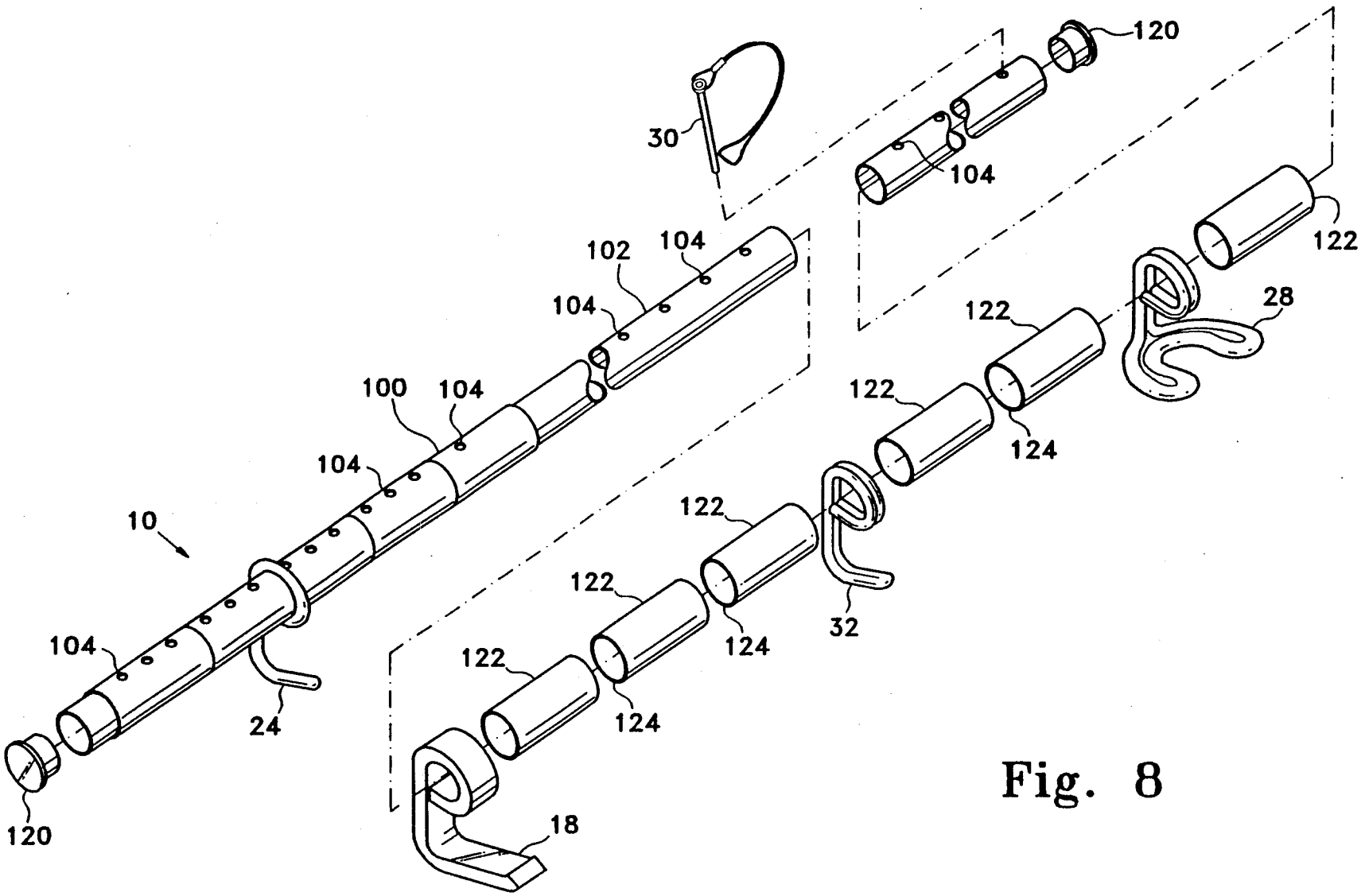
FIG. 8 is an exploded perspective view of a sports equipment rack according to the present invention illustrating the parts assembly and the use of spacer tubes to maintain a desired spacing between adjacent hanger elements, and the use of different types of hangers on the same sports equipment rack.

Naturally, the specialized equipment hooks 18, 24, 28, 32 may all be used on a single rack 10, as shown in FIG. 8, and the various hooks may be placed in any order or arrangement and in such numbers as desired. That is, a single rack 10 may include various numbers of each type of specialized equipment hook 18, 24, 28, 32, or spacer sleeves 122 (FIG. 8). Alternatively, a rack 10 may be fitted completely with a single type of equipment hanger, as illustrated in FIG. 1 where the top equipment rack 10 includes only helmet hooks 18, the center equipment rack 10 includes only fielding glove hooks 24, and the bottom equipment rack 10 includes only bat hooks 28.

Figure 5:
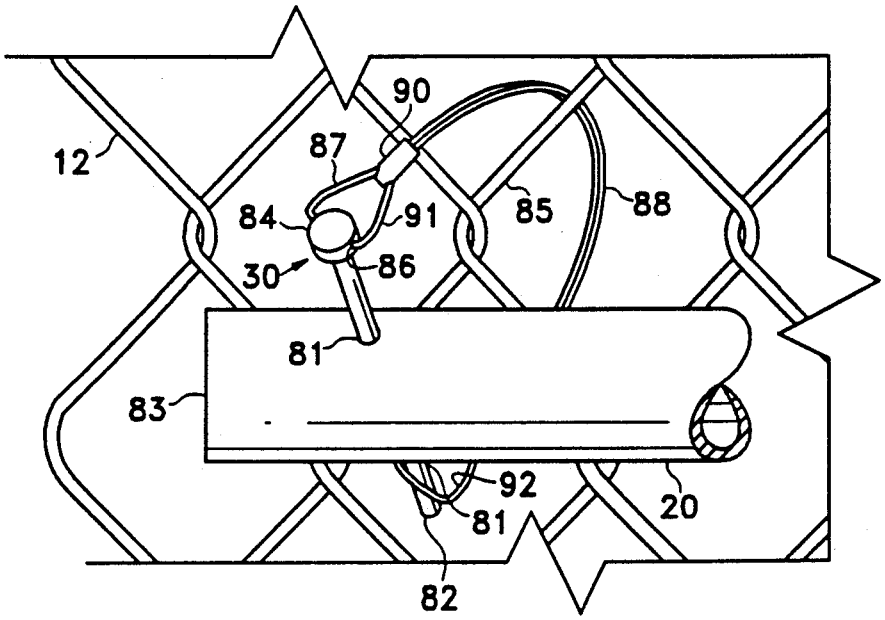
FIG. 5 is a front elevation of a fragment of a tubular mounting member mounted on a chain-link fence according to the present invention.
Figure 6:
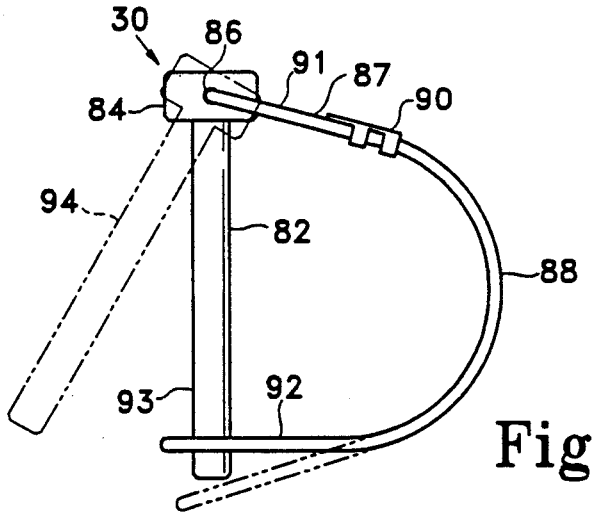

Referring now to FIGS. 5, 6 there is shown a front elevation of a portion of a tubular mounting member 20 secured to a chain-link fence 12, such as that normally found at amateur ball parks, by the clevis pin 30, which penetrates a pair of aligned apertures 81 through the side walls of the tubular member 20 adjacent to one end 83 of the tubular member 20, which are aligned across a diameter of the tubular member, that is, aligned perpendicular to a longitudinal axis of the tubular mounting members 20. The clevis pin 30 includes an elongated solid pin member 82 having a head 84. The elongated solid pin member 82 penetrates the apertures 81, with a portion of the pin member 82 extending from both sides, i.e., top and bottom as shown in FIG. 5, of the tubular mounting member 20 and secures the rack 10 to the fence 12 by means of a double loop wire bail 88 that passes behind at least one wire 85 of the fence 12. The wire 87 that forms the bail 88 passes through an aperture 86 in the head 84 of the pin 82 to form a small loop 91 between the head 84 and a crimp fastener 90 secured to the bail 88. The other end of the bail 88 is a securing loop 92.

As shown in FIG. 6 by the phantom pin 94, the double loop wire bail 88 is free to pivot about the aperture 86 and the securing loop 92 is moved into a position engaged with a lower portion 93 of the pin 82. The wire bail 88 is made of spring steel, which keeps the bail 88 engaged on the pin 82 until it is manually released or unfastened. One clevis pin 30 and aperture arrangement as described herein, which comprises one suspension latch, is located at each end of a rack 10, and others may be located at points intermediate of the two ends of a rack 10 if desired or necessary to support the weight of the equipment.

Figure 7:
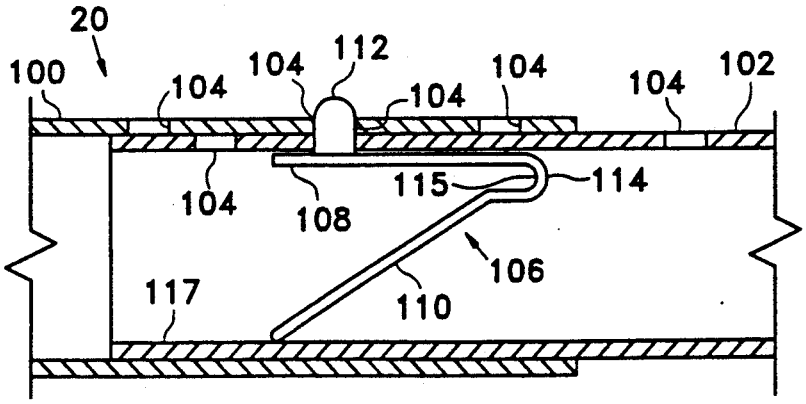
FIG. 7 is a side elevation partially in section illustrating a snap button fastener for adjusting and locking the total effective length of two telescoping tubular rack sections into place according to the present invention.

Referring now to FIG. 7, there is shown a fragmentary cross sectional elevation of telescoping tubular support members 20, illustrating the telescoping nature of the rack 10 and a preferred means for locking two or more telescoping tubular support members 20 into relative position to form a rack 10 of a desired length, namely a snap button fastener 106, having a snap button 112 that penetrates two aligned apertures 104. A larger diameter tubular member 100 sideably receives a smaller diameter tubular member 102 and the two tubular members 100, 102 are sized so that tubular member 102 fits snugly within tubular member 100 and yet the two tubular members 100, 102 slide relative to one another with ease. Naturally this principle may be extended to any desired number of tubular members, for example, 3, 4, or 5 nesting tubes may be used to form one rack 10. The telescoping nature of the rack 10 allows it to be collapsed for easy, space-saving storage when not in use, or to accommodate adequately different amounts of equipment, and so forth. Each tubular member 100, 102 includes a plurality of spaced apertures 104 through one side wall of the tube only, and the apertures 104 are preferably aligned along a single straight line parallel to the longitudinal axis of each tubular member 100, 102 and are preferably equally spaced on different tubular members.

Still referring to FIG. 7, the snap button fastener 106 provides a means for locking two telescoping tubular members 100, 102 into place when the rack 10 is at a desired length. The snap button fastener 106 is formed from a single length of material, such as spring steel or resilient spring-like plastic, and includes a straight base portion 108 that bears against an inside wall of the smaller diameter tubular member 102, a bent spring portion 114 and a straight pin portion or snap button 112 extending vertically upward as shown in FIG. 7 and fixed to the straight base portion 108. The bend 114 forms a U-shaped spring channel 115, which leads to a straight spring portion 110 that is directed diagonally downward from the right to the left as shown in FIG. 7., until it contacts the inside wall 117 of the smaller diameter tubular member 102. The snap button fastener 106 is thus compressed by the inner side walls of the smaller diameter tubular member 102, allowing its resilience to snap the snap button 112 into its locking engagement with two the apertures 104. The pin portion 112 is easily depressed with a thumb or finger to a point below the inside edge of a side wall of the larger diameter tubular member 100, allowing the overall length of the rack 10 to be adjusted by sliding the tubular members 100, 102 relative to one another. When the desired length is reached, it is easy to align one aperture 104 in the larger diameter tubular member 100 with an aperture 104 in the smaller diameter tubular member 102, which carries the snap button fastener 106, which then snaps the snap button 112 through the aperture 104 in the larger diameter tubular member, thereby locking the two members 100, 102 into position and preventing the two members from becoming disengaged when the weight of the equipment is placed on the rack 10.

Referring now to FIG. 8, there is shown an exploded view of the portable modular sports equipment rack 10, which includes all the elements previously discussed, and, in addition, a pair of tube end caps or plugs 120, which are made of plastic, rubber or the like and can be simply pushed into the ends of the tubular members 20 to prevent debris from accumulating inside the tubes, to provide a smooth surface and thereby eliminate the possibility that someone may be scratched or otherwise injured by the sharp edges of tube ends, and presenting a pleasing appearance. Also new to FIG. 8 is the use of spacer sleeves 122, which are relatively short tube sections having a diameter larger than the outside diameter of the large diameter tubular member 100, so that the spacer sleeves 122 can slide freely along any of the tubular members of the rack 10, but which also have a diameter large enough to prevent any of the specially designed equipment hangers described herein from sliding past an end 124 of a spacer sleeve 122. The spacer sleeves 122 can be installed on the tubular members alternately with any style of hanger, that is, the glove hooks 24, 32, bat hooks 28 or helmet hooks 18, which may be arranged in any desired order. When spacer sleeves are used between all successively adjacent hooks, the rack 10 cannot be collapsed without removing the hooks and spacer sleeves 122 first. In some instances, however, this apparent disadvantage becomes an advantage, for when the rack 10 is fitted with a spacer sleeve between some, most or all of the various hooks, it can be carried as a single elongated unit, by either one or two persons, with the equipment in place on the various hooks. This allows a rack 10 to be removed from a fence and from a field quickly at the conclusion of a game with the equipment still suspended. This substantially reduces the amount of time required to leave the field after a game, an important consideration in many amateur ball games where another set of teams is usually waiting to start their game the minute the current game is completed. Further, all the equipment can be carried to a car, station wagon, minivan or the like and placed on the floor or side wall of the vehicle for transport to a remote storage site, where the same rack 10, with the equipment still suspended from the specialized hooks, can be suspended from a wall in the storage facility. This flexibility dramatically reduces the number of times equipment must be handled during the course of preparing for, playing, and after-game transport and storage. In addition, a rack 10 provides a better temporarily or permanent storage solution than the typical practice of throwing equipment into a corner, box, or bag.

The helmet hook 18, the single weight glove hook 24, the double weight glove hook 32, and the bat hook 28 are all preferably made from aluminum stock. Further, at least the equipment hook portion of each of these specialized hooks is coated with a solid soft plastic, such a conventional tool-dip or the like to present a pleasing appearance, prevent marring of the equipment and to prevent aluminum from rubbing off on the users' hands. Alternatively other types of finishes may be used, such as anodizing, plating, bonded paint, dry film finish and so forth, which, of course, may also be used on the tubular members 20, 100, 102 for the same reasons. The rack 10 can of course include supporting members that are not tubular, for example, hexagonal, octagonal, and the like, and, indeed, some may even be solid, such as fiberglass, plastic and the like. Further, the glove hooks, helmet hooks, bat hooks, and even the tubular support members can be made of plastic, fiberglass, molded nylon or other suitable materials in which case the bends, curves, circular portions and other shapes are formed or molded, instead of being made by bending, as described above in conjunction with metal components. These alternative materials, or metals, which can be finished by anodizing, plating, bonded paint, dry film and so forth, can be made in team colors and the like.

As discussed above, most amateur batting helmets 16 have two ear flaps 17 and an ear hole 19 in each ear flap 17. This feature of such helmets allows the frame pole 21 to be used for transporting helmets easily in a minimum of space by interlacing the ear flaps 17 of adjacent helmets and inserting the frame pole 21 through the ear holes of a number of helmets. This provides a very convenient and compact means for transporting enough helmets for an entire team.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A sports equipment rack comprising:

a. a support member, said member forming a frame and means for suspending said frame from a vertical surface;

b. a plurality of hooks specially adapted for hanging different types of sports equipment therefrom;

c. said frame member further comprises a plurality of nesting telescoping tubular support members including means for locking said tubular support members at a desired length; and d. said suspending means further comprises a pair of aligned apertures through two side walls of said frame and a clevis pin inserted through said two apertures at each end of said frame, said clevis pin further comprising a bail which is inserted through a chain link fence.

2. A sports equipment rack in accordance with claim 1 further comprising at least one spacer sleeve between at least two said hooks.

3. A sports equipment rack comprising:

a. a support member, said member forming a frame and means for suspending said frame from a vertical surface;

b. a plurality of hooks specially adapted for hanging different types of sports equipment therefrom;

c. a plurality of bat hooks adapted for slidable movement along said frame and for receiving and retaining one bat in each said bat hook, wherein each said bat hook further comprises an upper circular mounting hook adapted for slidable movement along said frame, a depending straight portion and a bat engaging portion including a pair of opposed curved arms defining a yoke for receiving and retaining the knob of a bat, wherein said yoke lies at an angle of 60–80 degrees to said depending straight portion.

4. A sports equipment rack comprising:

a. a plurality of nesting telescoping tubular support members including means for locking said tubular support members at a desired length, thereby forming a frame and means for suspending said frame from a vertical surface;

b. a plurality of hooks specially adapted for hanging different types of sports equipment therefrom, including at least one fielding glove hook adapted for slidable movement along said frame and for receiving and retaining one fielding glove on said fielding glove hook, at least one helmet hook adapted for slidable movement along said frame and for receiving and suspending one batting helmet on said helmet hook, and at least one bat hook adapted for slidable movement along said frame and for receiving and retaining one bat in said bat hook; and at least one spacer sleeve between each said hook, with each said spacer sleeve adapted form slidable movement along said frame.

5. A sports equipment rack comprising:

a. a plurality of nesting telescoping tubular support members including means for locking said tubular support members at a desired length thereby forming a frame and means for suspending said frame from a vertical surface; and b. a plurality of hooks specially adapted for hanging different types of sports equipment therefrom, including at least one fielding glove hook adapted for slidable movement along said frame and for receiving and retaining one fielding glove on said fielding glove hook, wherein said fielding glove hook further comprises an integral glove hook including a curved upper portion adapted for slidable movement along said frame, a straight depending portion terminating in a glove engaging portion disposed at an angle of 45–65 degrees from said straight depending portion; at least one helmet hook adapted for slidable movement along said frame and for receiving and suspending one batting helmet on said helmet hook, wherein each said helmet hook further comprises an integral helmet hook formed of material having a rectangular cross section and including an upper curved mounting hook portion adapted for slidable movement along said frame, a straight depending portion and a helmet engaging portion disposed at an angle of 65–85 degrees to said straight depending portion; and at least one bat hook adapted for slidable movement along said frame and for receiving and retaining one bat in said bat hook, wherein each said bat hook further comprises an upper circular mounting hook adapted for slidable movement along said frame, a depending straight portion and a bat engaging portion including a pair of opposed curved arms defining a yoke for receiving and retaining the knob of a bat, wherein said yoke lies at an angle of 60–80 degrees to said depending straight portion.

6. A sports equipment rack in accordance with claim 5 further comprising at least one spacer sleeve between each said hook, with each said spacer sleeve adapted for slidable movement along said frame.

7. A sports equipment rack in accordance with claim 5 wherein said locking means further comprises a row of spaced apertures in a line through one side wall of said tubular members and a snap button fastener seated within one said tubular member for engaging one of said apertures in each of two said tubular members when said two apertures are aligned.

8. A sports equipment rack in accordance with claim 5 wherein said suspending means further comprises a pair of aligned apertures through two side walls of said frame perpendicular to a longitudinal axis of said frame and a clevis pin inserted through said two apertures to form suspension latch, with at least one said suspension latch at each end of said frame.

* * * * *